United States Patent [19]

Cochran

[11] 4,187,662

[45] Feb. 12, 1980

[54] APPARATUS FOR REMOVING PRESSURE SENSITIVE TAPE FROM CONTAINERS

[75] Inventor: Donald D. Cochran, Bartlett, Ill.

[73] Assignee: Packaging Systems, Inc., Itasca, Ill.

[21] Appl. No.: 947,448

[22] Filed: Oct. 2, 1978

[51] Int. Cl.[2] ..... B65B 43/40

[52] U.S. Cl. ..... 53/381 A; 271/196; 414/744

[58] Field of Search ..... 53/381 A; 81/3.2; 271/97, 195, 196; 414/744

[56] References Cited

U.S. PATENT DOCUMENTS

| | | | |
|---|---|---|---|
| 2,995,883 | 8/1961 | Aubry et al. | 53/381 A |
| 3,067,552 | 12/1962 | Aubry | 53/381 A X |

*Primary Examiner*—Travis S. McGehee

*Attorney, Agent, or Firm*—McDougall, Hersh & Scott

[57] ABSTRACT

A rotor provided with a plurality of air holes therethrough is driven by a vertically mounted shaft. The rotor is disposed beneath a stator provided with two plenums or manifolds on opposite sides thereof. One plenum is pressurized while the other plenum is maintained at a reduced pressure. The rotor is positioned above a bottle line which conveys bottles having tape thereon which must be removed prior to filling the bottles. The vacuum plenum causes the tape to be lifted from the bottles and drawn against the rotor. As the rotor turns it reaches the pressurized plenum where reverse air flow causes the tape to drop into a collecting receptacle.

9 Claims, 6 Drawing Figures

APPARATUS FOR REMOVING PRESSURE SENSITIVE TAPE FROM CONTAINERS

BACKGROUND OF THE INVENTION

This invention relates to the field of container filling equipment. More specifically, it relates to the field of equipment for preparing and conveying containers, such as milk bottles, to automatic filling equipment. The traditional method of packaging milk of similar fluids has been to utilize glass containers or plastic coated paper containers which are maintained in a sanitized condition prior to filling. Recently, however, due to technological advance and cost efficiency, plastic containers have become increasingly utilized for this purpose. Such containers are usually blow molded from suitable plastic, such as polyethylene, at a plastic molding facility. The nature of the manufacturing process renders the interior of these containers sanitary and thus, if they are maintained in a sealed condition prior to filling, no additional sanitizing steps need be taken.

To achieve that purpose the plastic containers have heretofore been packaged in large polyethylene bags. The disadvantage of this procedure is that the packing is usually accomplished manually and the unpacking similarly requires manual labor. Further, once unpacked at the bottling plant, such containers often must travel a considerable distance in an unprotected condition thereby possibly permitting contamination prior to being filled and capped.

A recent development to solve this problem has been the use of pressure sensitive tape cut to an appropriate size and shape to be attached to and seal the opening of each container as it comes off the plastic molding line at the point of manufacture. A number of such tapes have been developed as well as equipment for applying the tape to the containers.

At present, however, there has been no satisfactory mechanism developed for automatically removing the pressure sensitive tape when the containers are on a filling line and ready to receive fluid. In many cases it is necessary to manually remove the tape and this adds unnecessary expense and is relatively inefficient.

According to the present invention an automatic machine is disclosed for removing the pressure sensitive tape utilized to seal unfilled containers. It is accordingly an object of the present invention to provide a method and apparatus for removing pressure sensitive tape from the tops of empty containers.

Another object of the invention is to provide a tape removal device which need not be synchronized to the bottle conveying line but will remove tape from bottles as they pass by the unit.

A further object of the invention is to provide a rotary tape remover employing vacuum to lift the tape from a container and a pressure source to positively deposit the tape in a collection bin to prevent jamming of the device.

Other objects and advantages of the invention will be apparent from the remaining portion of the specification.

PRIOR ART STATEMENT

In accordance with the provisions of 37 CFR 1.97, applicant states that the closest prior art of which he is aware constitute the manual procedures described in the background portion of this specification.

DETAILED DESCRIPTION

Figure 1:
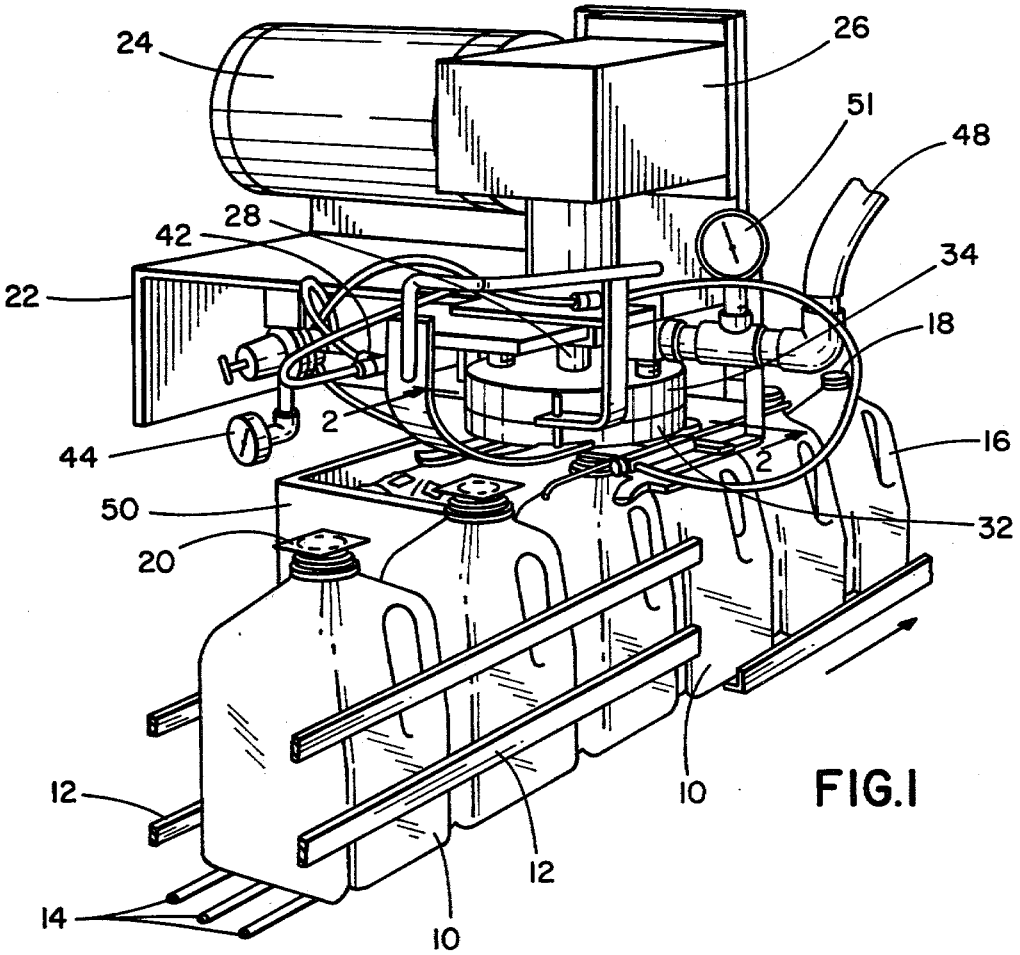
FIG. 1 is a perspective view of a bottle conveyor with the apparatus according to the invention installed thereover.

Referring to FIG. 1, the environment in which the invention is utilized is illustrated. A plurality of containers 10, preferably plastic, are conveyed on a conveyor means including side rails 12 and support rails 14. The containers may include handle portions 16 or not, as desired, but in all cases are provided with a top opening 18 through which the containers are filled and from which the liquids received therein are subsequently dispensed by the consumer.

The containers 10 are provided at the manufacturing plant with a suitably sized and shaped pressure sensitive tape 20 disposed over the opening 18. The tape is placed on the containers as early as practicable at the point of manufacture to ensure that the interior of the containers remain sanitary. At a filling plant the tape 20 must be removed prior to filling the containers and capping them. Preferably, this is accomplished just prior to the bottles being conveyed into the automatic filling machinery of the type usually found at a dairy or other bottling plant. Removal of the pressure sensitive tape, according to the invention, is accomplished by a mechanism conveniently mounted to a bracket 22.

Figure 2:
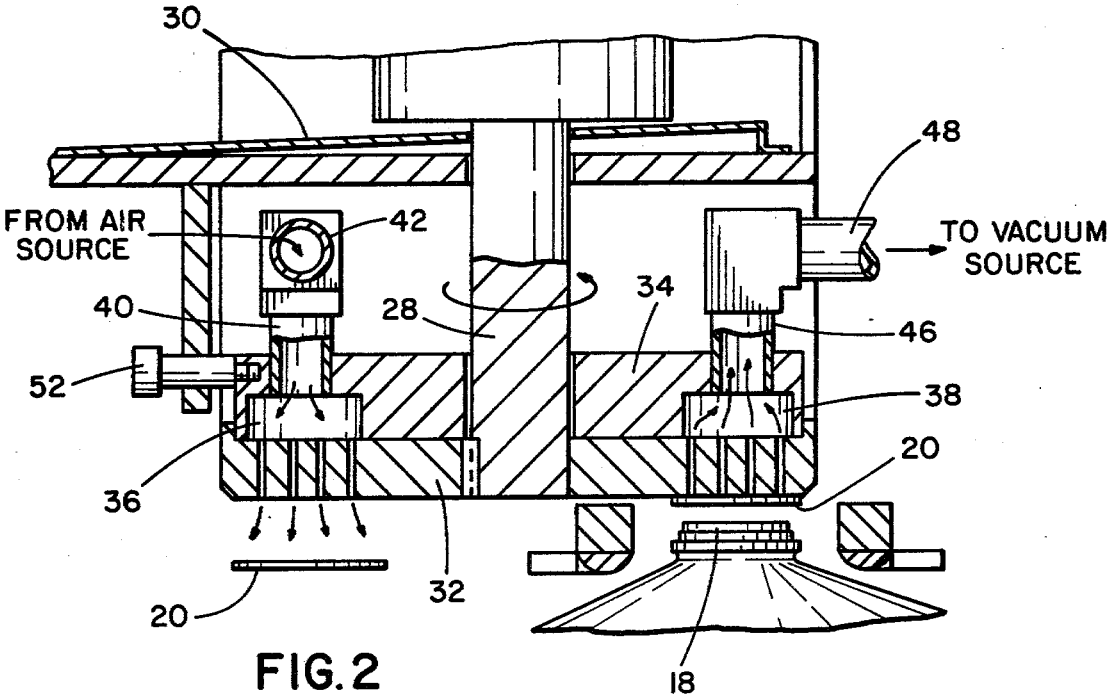
FIG. 2 is a cross sectional view through the invention along the lines 2—2 of FIG. 1.
Figure 4:
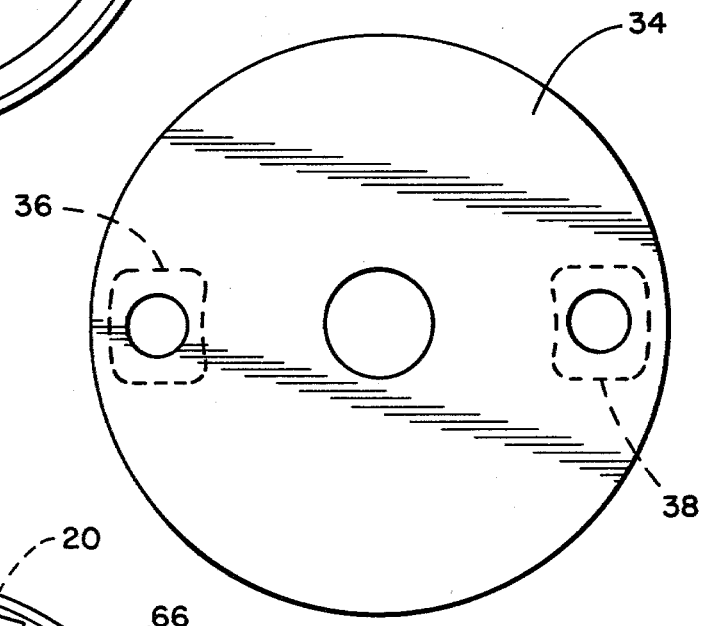
FIG. 4 is a plan view of the stator according to the invention.
Figure 5:
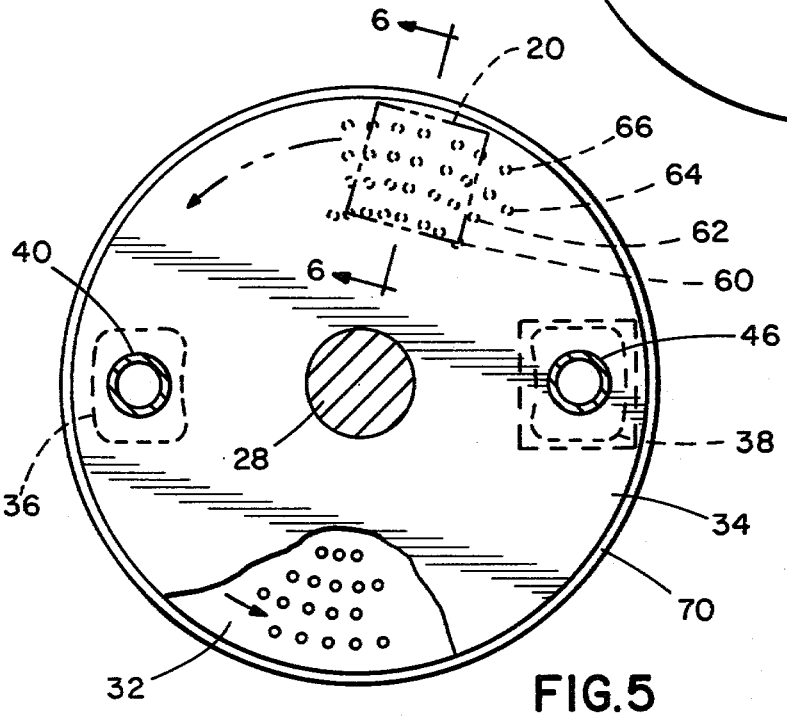
FIG. 5 is a top plan view of the rotor-stator assembly having portions cut away to reveal the operative relation therebetween.

The tape removal mechanism is motor driven by means of a small horsepower electric motor 24 through a gear box 26. As best shown in FIG. 2, a drive shaft 28 extends downwardly from the gear box passing through a suitable opening in a drip shield 30 provided to prevent lubricants or other contaminants from touching the containers. A rotor 32 is secured to the end of the drive shaft 28 for rotation therewith in a manner to be described. A stator 34 is mounted above the rotor and the drive shaft passes therethrough. The stator has provided therein a pair of plenum chambers or manifolds 36 and 38. The two plenum chambers are provided on opposite sides of the drive shaft spaced as shown in FIG. 4. Plenum 36 is connected to a channel 40 which terminates in a coupling 42 suitable for connection to a source of air pressure applied via a flexible hose. If desired, an air pressure gauge 44 may be provided to accurately determine the air pressure applied to the plenum 36. Similarly, the plenum 38 communicates with a channel 46 which, in turn, is connected to a vacuum line 48 ultimately connected to a vacuum pump (not shown). If desired, a gauge 50 may be provided to accurately determine the reduced pressure maintained in the plenum 38.

During operation of the device the rotor 32 rotates with the drive shaft 28. The stator 34 does not move. Prior to operating the device, however, the stator may be rotated about the shaft in order to position the plenums 36 and 38 at desired locations relative to the bottle conveyor line and a label collection bin 50 which receives the removed tape. Movement of the stator is accomplished by loosening a shoulder bolt 52 secured through the mounting bracket 22 and normally engaging the stator during operation of the device.

Figure 3:
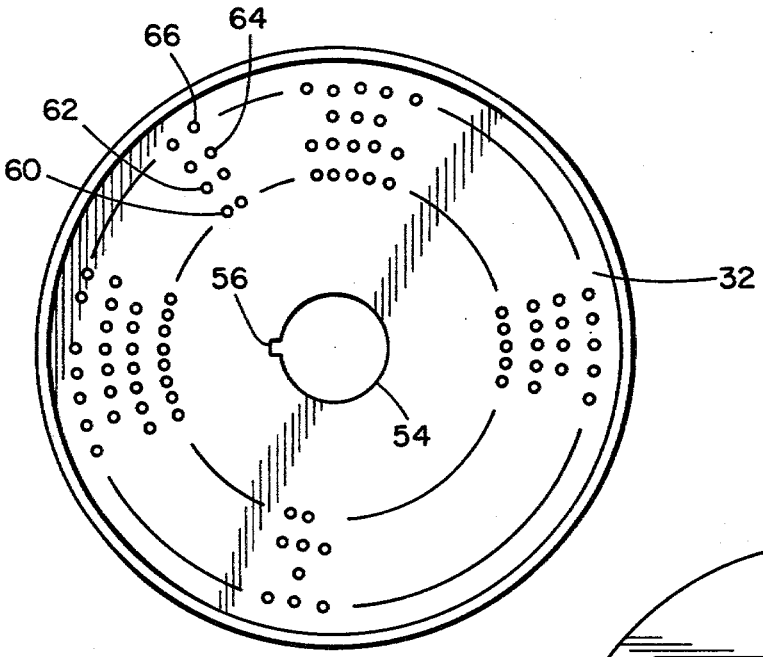
FIG. 3 is a bottom plan view of the rotor according to the invention.

Referring to FIG. 3, the construction of the rotor can be seen in detail. The rotor is a relatively thick circular disk having a central opening 54 including a keyway 56 for positively engaging the drive shaft for rotation therewith. Provided at increasing radii from the center of the rotor are apertures passing vertically through the rotor with the apertures of a given radii forming a substantially complete circle concentric with the central opening 54. Thus, while only a representative number of apertures are shown in FIG. 3, it will be appreciated that in actuality there are four or more rings of apertures through the rotor forming air passageways. The FIG. 3 embodiment has four rings designated as 60, 62, 64, and 66. A greater or lesser number of rings could be provided, as desired, depending upon the air pressures utilized, the size of the tape element to be removed and similar considerations. Typically, the apertures will be on the order of 1/16 inch in diameter and spaced approximately 5° apart within each ring.

Figure 6:
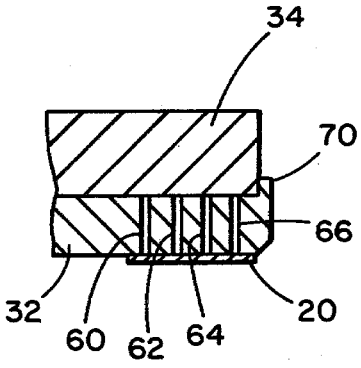
FIG. 6 is a partial sectional view along the lines 6—6 of FIG. 5 on an enlarged scale.

As seen in FIGS. 2 and 6, the outer portion of the rotor includes an upwardly extending tapered element 70 which rides along the outside circumference of the stator 34. This construction is provided to help prevent air transmission to or from the plenums via the space between the rotor and stator. The bottom of the rotor is preferably coated with a nonstick coating of the type sold under the trademark TEFLON, to insure that the pressure sensitive tape is easily removed from the rotor and deposited in the collection bin 50.

The operation of the device is as follows. When containers are present on the conveyor system the tape remover is made operational either automatically by means of a microswitch or it is manually actuated. When motor 24 is operating drive shaft 28 rotates in the direction indicated in FIG. 2 rotating the rotor 32 relative to the stator 34. The vacuum line connected to plenum 38 attempts to maintain the plenum at a subatmospheric pressure thereby causing air to be drawn into the plenum through the apertures in the rotor. Desirably, the vacuum source connected to the plenum will be capable of maintaining a vacuum of approximately 25 to 30 inches of mercury. The air flow thus created is sufficient to lift the pressure sensitive tape 20 from the top of a container when the container passes beneath the rotor in the vicinity of plenum 38.

The tape lifted from the container is securely maintained on the underside of the rotor by the vacuum source since the tape serves to seal off the openings over which it is seated increasing the vacuum force on the tape. As the rotor turns, the tape is carried from the bottle line to the collection bin 50. When the rotor carries the tape past the vacuum plenum 38, the vacuum force holding the tape in place will gradually dissipate to the point where the tape will normally drop from the rotor into the bin by force of gravity. Occasionally, however, tape will stick to the surface of the rotor even in the absence of any vacuum force and may interfere with proper operation of the device. Therefore, tape which does not automatically drop from the rotor is affirmatively displaced therefrom when the holes over which the tape is seated reach the air pressure plenum 36. Plenum 36 is preferably connected to a source of air pressure of approximately five pounds per square inch and, consequently, air flows from the plenum through the apertures in the rotor in a downward direction with sufficient velocity and force to dislodge the tape from the rotor.

By providing a plurality of holes over a substantial portion of the rotor, it is unnecessary to synchronize the operation of the tape removal device with the operation of the bottle conveyor mechanism. Whenever a bottle passes beneath the vacuum plenum 38 the tape will be lifted from the bottle onto whatever sector of the rotor is then positioned in alignment with the plenum. This rotating pick off action results in a highly efficient tape removal mechanism capable of handling from 10 to 75 containers per minute, speeds which are fully compatible with automatic filling equipment presently utilized.

While I have shown and described embodiments of this invention in some detail, it will be understood that this description and illustrations are offered merely by way of example, and that the invention is to be limited in scope only by the appended claims.

I claim:

1. A device for removing tape from the tops of containers moving along a conveyor comprising:

(a) a rotor positioned above the containers provided with a plurality of vertical air passages therethrough, (b) a stator disposed above the rotor provided with first and second plenum chambers, said chambers being spaced one from the other, said first chamber being positioned directly over the containers on said conveyor, (c) means for rotating said rotor relative to said stator to cause the air passages to alternately communicate with said first and second plenum chambers, (d) means for maintaining said first chamber below atmospheric pressure and said second chamber above atmospheric pressure, whereby the partial vacuum maintained in said first chamber draws air upwardly through the rotor air passages creating a force sufficient to remove said tape from said container, and temporarily position it on said rotor, the increased pressure maintained in said second chamber subsequently effecting removal of tape positioned on the rotor.

2. The device according to claim 1 further including means for positioning said stator relative to said conveyor to correctly locate said first chamber over said conveyor.

3. The device according to claim 1 further including means positioned adjacent said conveyor beneath said second plenum chamber for receiving the removed tape.

4. The device according to claim 1 wherein said rotor is disk shaped and secured to said rotating means at its center.

5. The device according to claim 1 wherein said air passages are arranged on said rotor in at least four concentric rings spaced from the center, each of said rings spaced so that the air passages communicate with the plenum chambers when positioned therebeneath.

6. The device according to claim 1 wherein said stator is disk shaped and the plenums are located at opposite ends of a line passing through the center, each plenum being dimensioned to overlie a plurality of air passages provided through said rotor.

7. The device according to claim 1 wherein said rotating means is a motor, a gear box and a drive shaft connected to said motor through said gear box, said rotor connected to said shaft for movement therewith.

8. The device according to claim 1 wherein said maintaining means includes:

(a) a vacuum pump and a line for attaching said pump to said first plenum to create and maintain a partial vacuum therein, (b) a source of compressed air and a line for attaching said source to said second plenum to maintain above atmospheric pressure therein.

9. The device according to claim 4 wherein said rotor includes an upwardly extending tapered element on its outer circumference dimensioned to engage and ride against said stator to reduce air transmission to or from either plenum via the space between the rotor and stator.

* * * * *

UNITED STATES PATENT AND TRADEMARK OFFICE

CERTIFICATE OF CORRECTION

PATENT NO. : 4,187,662

DATED : February 12, 1980

INVENTOR(S) : Donald D. Cochran

It is certified that error appears in the above-identified patent and that said Letters Patent are hereby corrected as shown below:

Column 1, line 10, "of" second occurrence should read -- or --.

Column 2, line 56, "applied" should read --supplied--

Column 2, line 62, "50" should read --51--

Signed and Sealed this

Fifth Day of May 1981

[SEAL]

Attest:

RENE D. TEGTMEYER

Attesting Officer

Acting Commissioner of Patents and Trademarks